US011771236B2

(12) United States Patent
Cheng

(10) Patent No.: US 11,771,236 B2
(45) Date of Patent: Oct. 3, 2023

(54) CHILD SEATING DEVICE AND SUPPORT FRAME THEREOF

(71) Applicant: WONDERLAND SWITZERLAND AG, Steinhausen (CH)

(72) Inventor: Manqun Cheng, Guangdong (CN)

(73) Assignee: WONDERLAND SWITZERLAND AG, Steinhausen (CH)

( * ) Notice: Subject to any disclaimer, the term of this patent is extended or adjusted under 35 U.S.C. 154(b) by 0 days.

(21) Appl. No.: 17/468,697

(22) Filed: Sep. 8, 2021

(65) Prior Publication Data

US 2022/0071408 A1 Mar. 10, 2022

(30) Foreign Application Priority Data

Sep. 8, 2020 (CN) ..... 202021952252.1

(51) Int. Cl.
*A47D 1/02* (2006.01)
*A47D 1/00* (2006.01)
*A47D 7/00* (2006.01)

(52) U.S. Cl.
CPC ..... *A47D 1/023* (2017.05); *A47D 1/002* (2013.01); *A47D 1/006* (2013.01); *A47D 7/005* (2013.01)

(58) Field of Classification Search
CPC .... A47D 1/023; A47D 13/105; A47D 1/0081; B62B 7/06
See application file for complete search history.

(56) References Cited

U.S. PATENT DOCUMENTS

2007/0049389 A1* 3/2007 Paesang ..... A47D 13/105 472/118
2014/0183843 A1* 7/2014 Iftinca ..... B62B 9/102 280/647
2020/0383490 A1* 12/2020 Tackaberry ..... A47D 11/00
2021/0261183 A1* 8/2021 Hartenstine ..... B62B 7/145

FOREIGN PATENT DOCUMENTS

CN 201658083 U 12/2010
CN 103963819 A 8/2014
CN 111409518 A 7/2020

* cited by examiner

*Primary Examiner* — Sarah B McPartlin

(57) ABSTRACT

The disclosure provides a support frame of a child seating device having unfolding and folding joints, bearing bases, a first stand and a second stand. The bearing base is formed on the unfolding and folding joint; the first stand is assembled with the unfolding and folding joints, the second stand is assembled with the unfolding and folding joints, and the second stand is connected pivotally to the first stand with the aid of the unfolding and folding joints. With the aid of the bearing bases, the support frame of the child seating device of the disclosure can be detached from or engaged with different child carriers, so that the support frame of the child seating device of the disclosure has multiple modes of use. In addition, the disclosure also provides a child seating device.

14 Claims, 9 Drawing Sheets

CHILD SEATING DEVICE AND SUPPORT FRAME THEREOF

CROSS-REFERENCE TO RELATED APPLICATION

This non-provisional application claims priority under 35 U.S.C. § 119(a) on Patent Application No(s). 202021952252.1 filed in China on Sep. 8, 2020, the entire contents of which are hereby incorporated by reference.

BACKGROUND OF THE INVENTION

1. Field of the Invention

The present disclosure relates to children supplies, and in particular to a child seating device and a support frame thereof with multiple modes of use.

2. Description of the Related Art

With the continuous improvement of people's living levels, children's supplies are widely entered into ordinary people's families.

It is well known that cribs, seats and carry cots are children's supplies; in order that cribs, seats and carry cots can stand reliably on the floor, the general cribs, seats and carry cots are equipped with stands to reliably stand on the floor through the use of stands, thus ensuring the proper use of cribs, seats and carry cots.

At present, cribs, seats or carry cots are fixedly mounted on stands, and they are non-disassemblable from the stands; although the stand is made into an unfolding and folding operation in order to save space when not in use, the non-disassemblable property between the cribs, seats or carry cots and the stand causes that the stand only has a single mode of use and is not versatile.

Therefore, there is an urgent need for a child seating device and a support frame thereof with multiple modes of use to overcome the above defects.

BRIEF SUMMARY OF THE INVENTION

One objective of the disclosure is to provide a support frame with multiple modes of use.

Another objective of the disclosure is to provide a child seating device with multiple modes of use.

To achieve the above objectives, the support frame of the child seating device of the present disclosure comprises unfolding and folding joints, bearing bases, a first stand and a second stand. The bearing base is formed on the unfolding and folding joint; the first stand is assembled with the unfolding and folding joints, the second stand is assembled with the unfolding and folding joints, and the second stand is connected pivotally to the first stand with the aid of the unfolding and folding joints.

Preferably, the unfolding and folding joint comprises a first pivotal base and a second pivotal base. The first pivotal base is used to assemble with the first stand; the second pivotal base is used to assemble with the second stand, the second pivotal base is connected pivotally to the first pivotal base, and the bearing base is formed on the first pivotal base or the second pivotal base.

Preferably, the unfolding and folding joint further comprises a joint engaging piece, and the joint engaging piece can be movably set at a pivot position of the first pivotal base and the second pivotal base, the joint engaging piece is used for engaging the first pivotal base and the second pivotal base, in order to lock a pivotal rotation between the first pivotal base and the second pivotal base.

Preferably, the first pivotal base has a first positioning groove formed thereon, the second pivotal base has a second positioning groove formed thereon, the joint engaging piece can be axially and movably set between the first pivotal base and the second pivotal base, and the joint engaging piece has a locking part; when the joint engaging piece moves to a locking position, the locking part is simultaneously engaged with the first positioning groove and the second positioning groove, in order to lock the pivotal rotation between the first pivotal base and the second pivotal base; when the joint engaging piece moves to a releasing position, the locking part is separated from the first positioning groove or the second positioning groove, so that the first pivotal base can be pivoted relative to the second pivotal base.

Preferably, the unfolding and folding joint further comprises an operating piece, and the operating piece can be movably set on one of the first pivotal base and the second pivotal base, the bearing base is located on another of the first pivotal base and the second pivotal base, the operating piece is used to drive the joint engaging piece to move to the releasing position.

Preferably, the operating piece is a button, and the button can move axially.

Preferably, the unfolding and folding joint further comprises an elastic element, which is used to drive the joint engaging piece, so that the joint engaging piece moves to the locking position.

Preferably, the elastic element is a spring, and the spring is set between the joint engaging piece and the first pivotal base or the second pivotal base on which the bearing base is located.

Preferably, in the releasing position, the first positioning groove or the second positioning groove separated from the locking part at least has the number of two, and at least two of the first positioning grooves or the second positioning grooves are separated from each other along a pivotal direction of the first pivotal base.

Preferably, after the first stand and the second stand are folded to each other, one of at least two of the first positioning grooves or the second positioning grooves is aligned axially with the locking part; after the first stand and the second stand are unfold to each other, another of at least two of the first positioning grooves or the second positioning grooves is aligned axially with the locking part.

Preferably, the joint engaging piece is a gear piece or a pin.

Preferably, the bearing base has a face-up connector.

To achieve the above objectives, the child seating device of the disclosure comprises a child carrier, an assembling base and the support frame. The child carrier is used to carry children, the assembling base is set on the child carrier, the assembling base and the bearing base are engaged with each other.

Preferably, the child carrier is a crib, a carry cot or a seat.

Compared with the state of the art, with the aid of the bearing bases formed on the unfolding and folding joint, the support frame of the disclosure has multiple modes of use when the bearing bases are connected fittingly with different child carriers; in addition, with the aid of the unfolding and folding joint, the first stand and the second stand can be folded or unfolded to each other according to the demand, thus facilitating storage. In addition, for the child seating device of the disclosure, with the aid of the assembling base engaging the bearing base, it makes the child seating device of the disclosure has multiple modes of use when the support frame is connected fittingly with different child carriers.

DETAILED DESCRIPTION OF THE INVENTION

To facilitate understanding of the technical contents, structures and characteristics of this present disclosure, embodiments together with the attached drawings for the detailed description of the present disclosure are provided.

Figure 1:
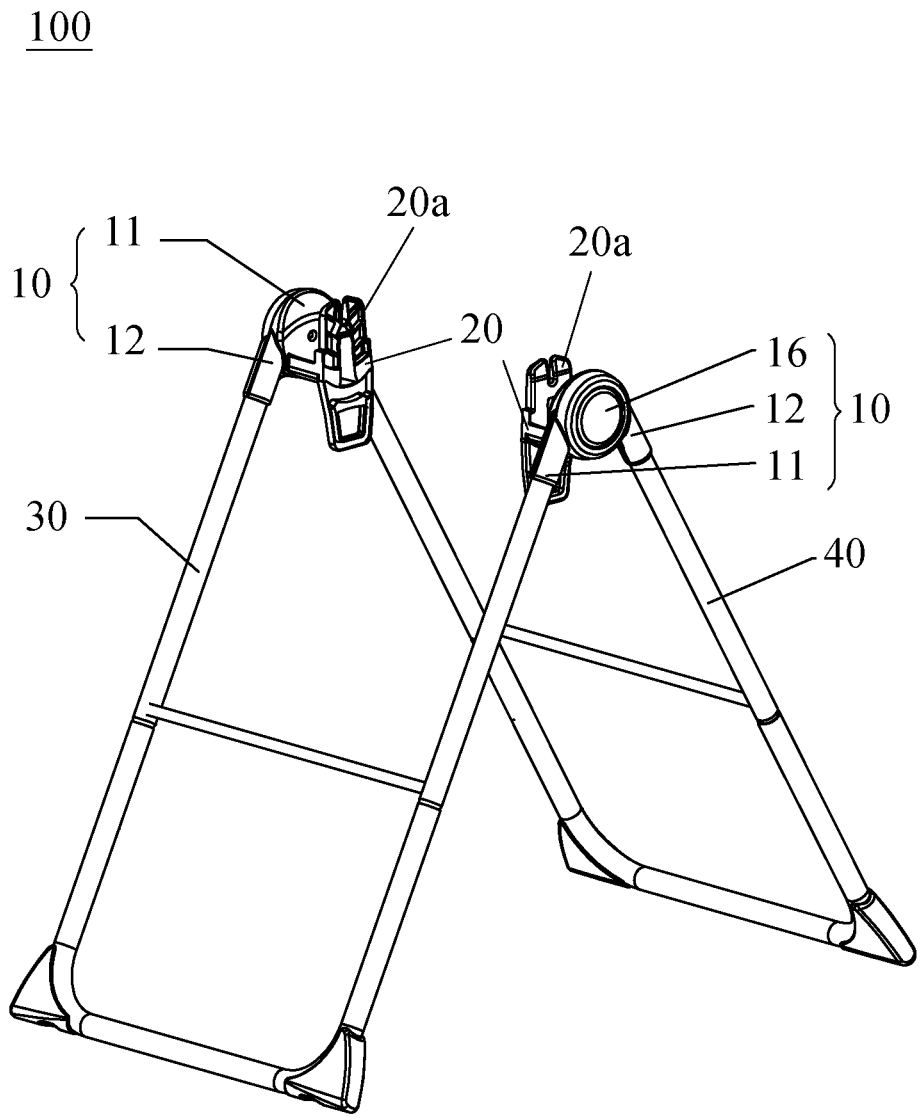
FIG. 1 is a schematic elevation of the structure of a support frame of a child seating device for children after unfolding of the present disclosure.
Figure 2:
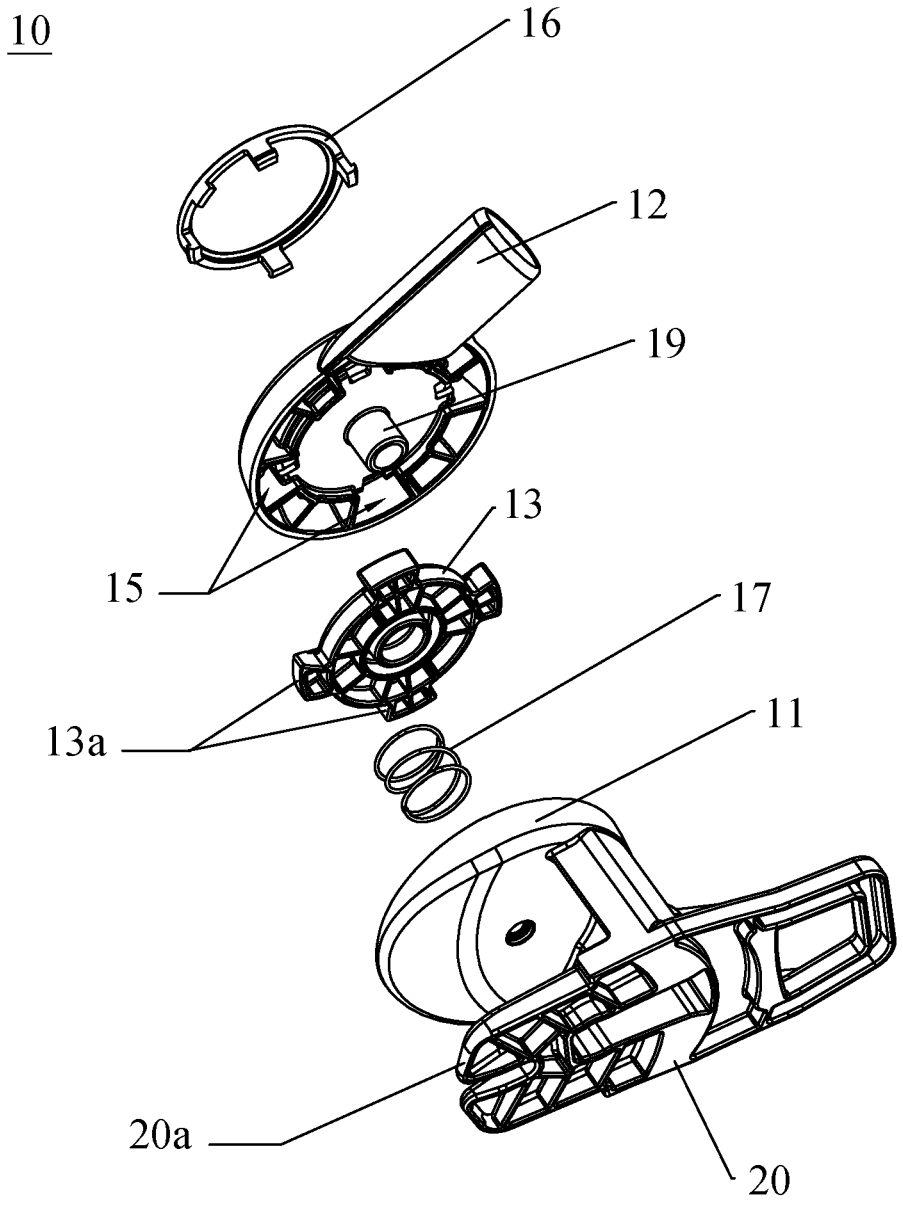
FIG. 2 is a schematic explosive elevation of the unfolding and folding joint shown in FIG. 1 in an angle.
Figure 7:
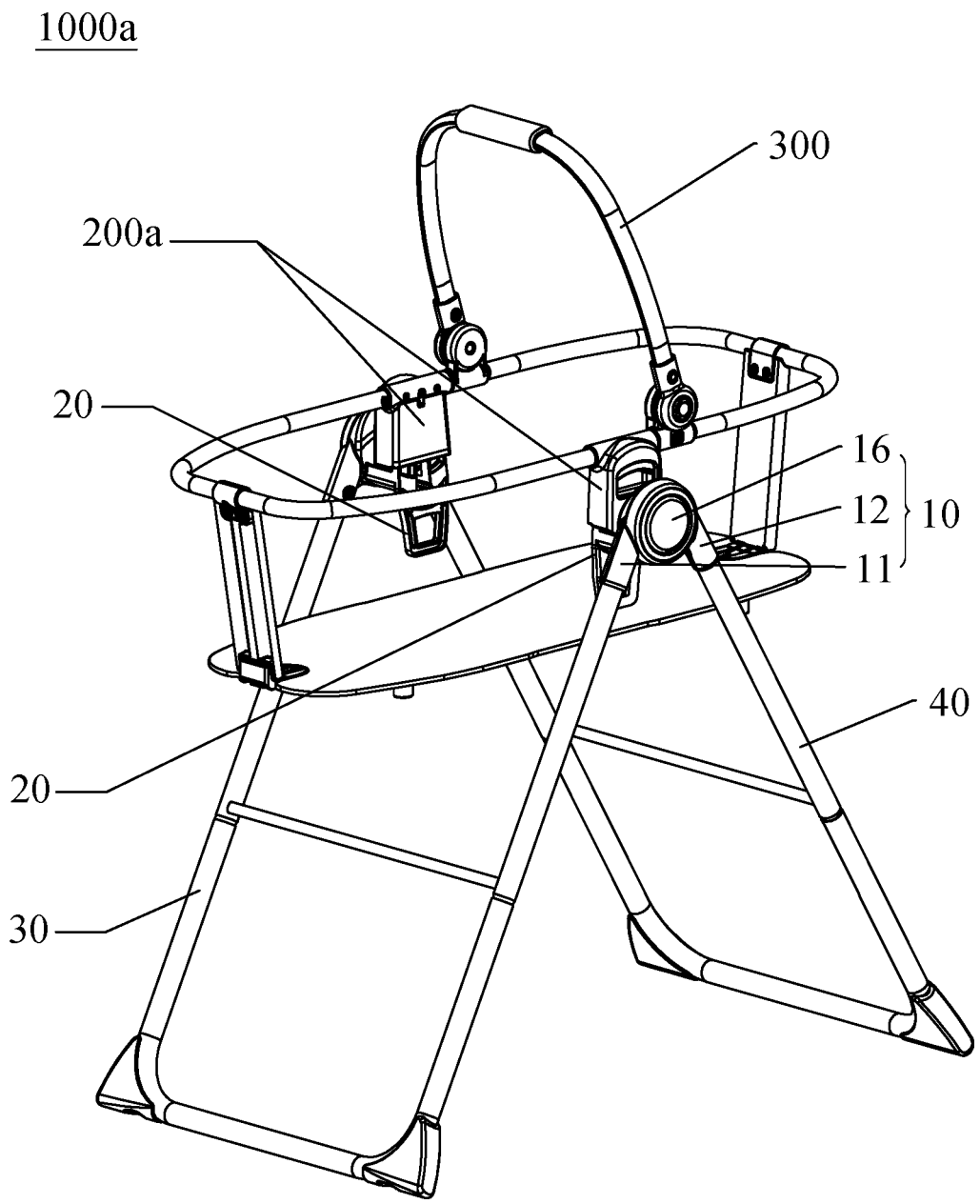
FIG. 7 is a schematic view in the state of the support frame shown in FIG. 1 connected fittingly to a crib.
Figure 8:
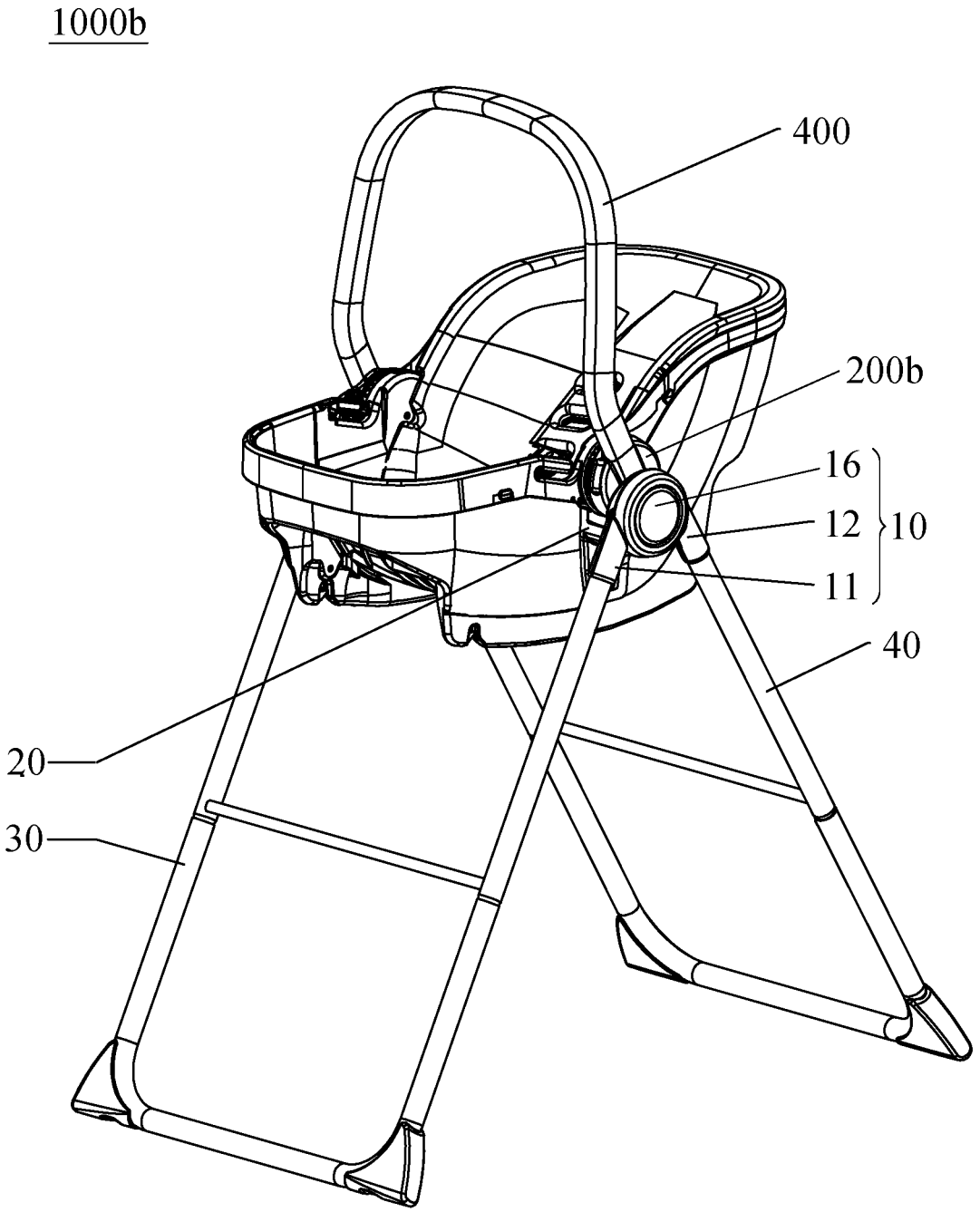
FIG. 8 is a schematic view in the state of the support frame shown in FIG. 1 connected fittingly to a carry cot.
Figure 9:
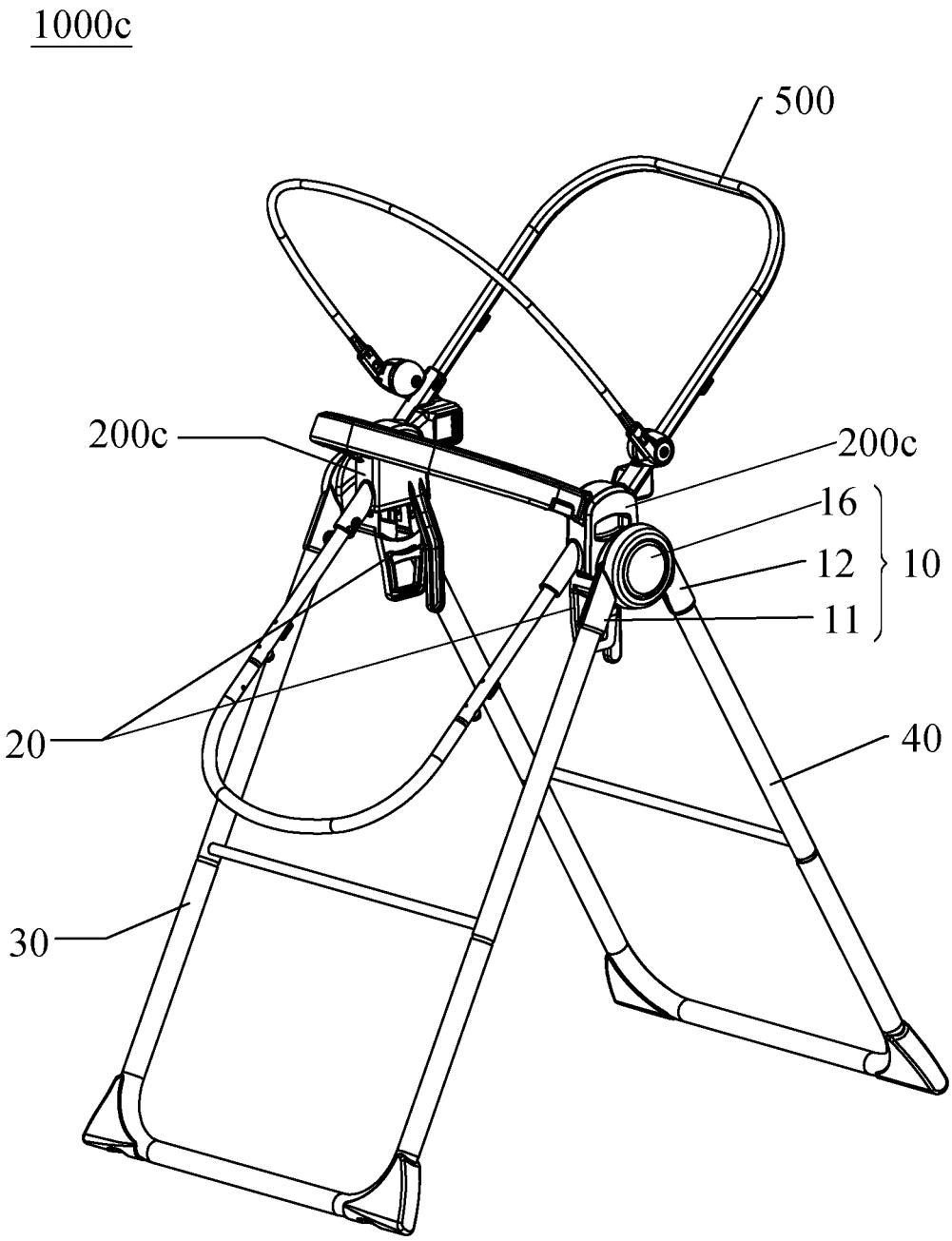
FIG. 9 is a schematic view in the state of the support frame shown in FIG. 1 connected fittingly to a seat.

Referring to FIG. 1, a support frame 100 of the disclosure includes unfolding and folding joints 10, bearing bases 20 and a first stand 30 and a second stand 40 respectively assembled with the unfolding and folding joints 10. The bearing base 20 is formed on the unfolding and folding joint 10, and the bearing bases 20 can be used to connect detachably with a crib 300 as shown in FIG. 7, a carry cot 400 as shown in FIG. 8 or a seat 500 as shown in FIG. 9; the second stand 40 is connected pivotally to the first stand 30 by the unfolding and folding joint 10, and the first stand 30 and the second stand 40 are connected pivotally to each other with the aid of the unfolding and folding joint 10. Specifically, the first stand 30 and the second stand 40 are U-shaped each, the first stand 30 and the second stand 40 are connected pivotally to each other at upper left ends thereof through one unfolding and folding joint 10, while the first stand 30 and the second stand 40 are also connected pivotally to each other at upper right ends thereof through one unfolding and folding joint 10 to ensure that the first stand 30 and the second stand 40 stand reliably on the floor after unfolding. Certainly, according to actual needs, the shape of the first stand 30 and the second stand 40 is not limited to herein. Understandably, in order to stand reliably, each of the first stands 30, the second stands 40 and the unfolding and folding joints 10 are arranged to be on left side and right side respectively. More specifically, the detailed description of the embodiment is as follows.

In combination with FIGS. 2 to 6, the unfolding and folding joint 10 includes a first pivotal base 11, a second pivotal base 12, a joint engaging piece 13, an operating piece 16 and an elastic element 17. The second pivotal base 12 is connected pivotally to the first pivotal base 11 to make the second stand 40 can be pivoted relative to the first stand 30, so that the support frame 100 can be in the folding state or in the unfolding state as shown in FIG. 1 according to different use needs; preferably, the first pivotal base 11 projects an inner shaft 18 from the center thereof that is toward the second pivotal base 12, and the second pivotal base 12 projects correspondingly an outer bushing 19 assembling outside the inner shaft 18, with the aid of cooperation between the outer bushing 19 and the inner axis 18, the purpose of the second pivotal base 12 connected pivotally to the first pivotal base 11 can be achieved. Certainly, according to actual needs, the way of the second pivotal base 12 connected pivotally to the first pivotal base 11 can be achieved by otherwise, so it is not limited to herein. The bearing base 20 is formed on the first pivotal base 11, so that the bearing base 20 is located on the inside of the unfolding and folding joint 10. Certainly, according to the actual needs, the bearing base 20 is formed on the second pivotal base 12, and located on the outside of the unfolding and folding joint 10, so it is not limited to herein. For example, the bearing base 20 and the first pivotal base 11 are manufactured together through injection molding way to make the bearing base 20 formed on the first pivotal base 11. Certainly, the bearing base 20 can also be formed on the first pivotal base 11 in an assembling form, but not limited to herein; in addition, the bearing base 20 has a face-up connector 20*a*, in order to plug and unplug with the assembling base 200*a* (200*b*, 200*c*) described below, but not limited to herein.

Figure 3:
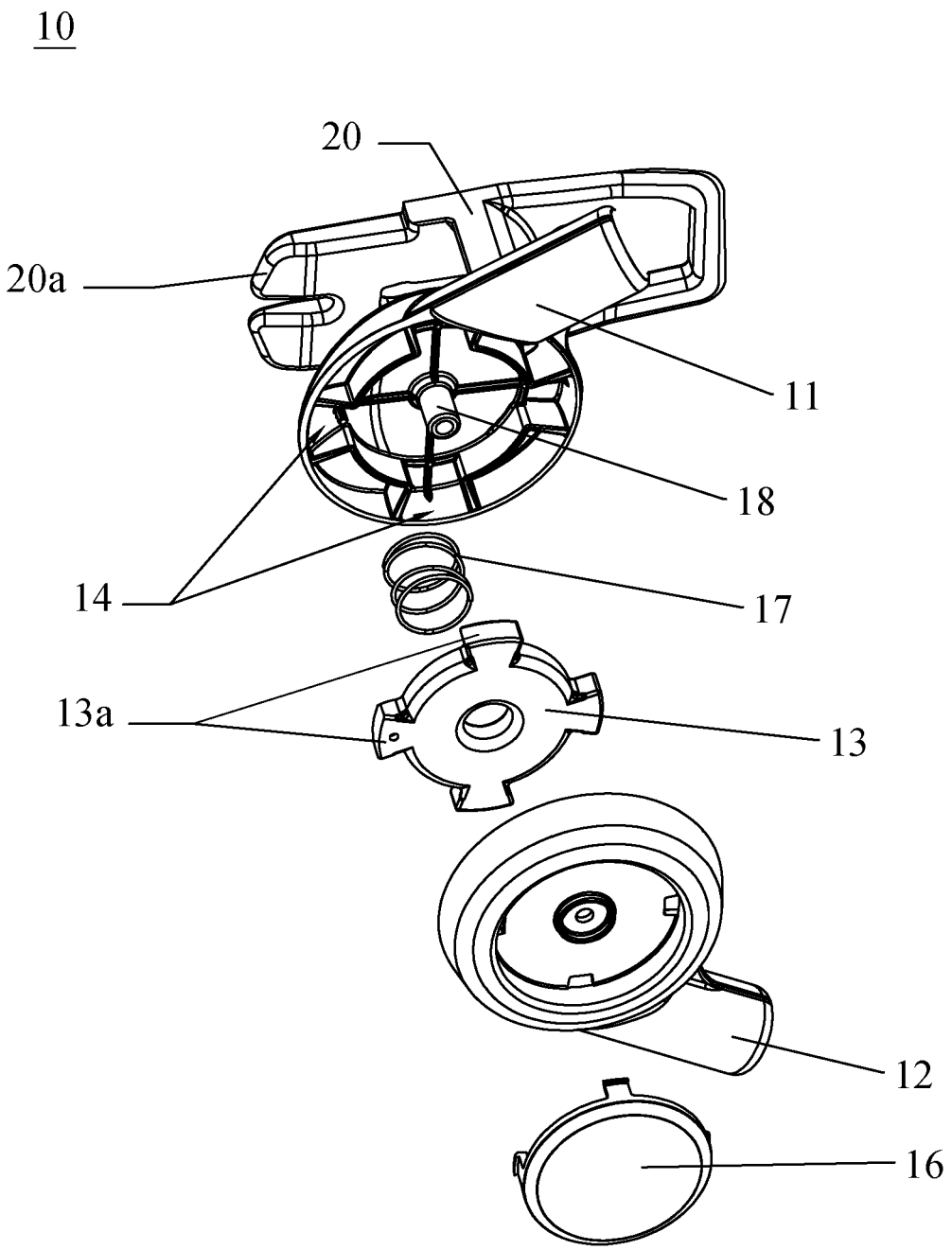
FIG. 3 is a schematic explosive elevation of the unfolding and folding joint shown in FIG. 1 in another angle.
Figure 4:
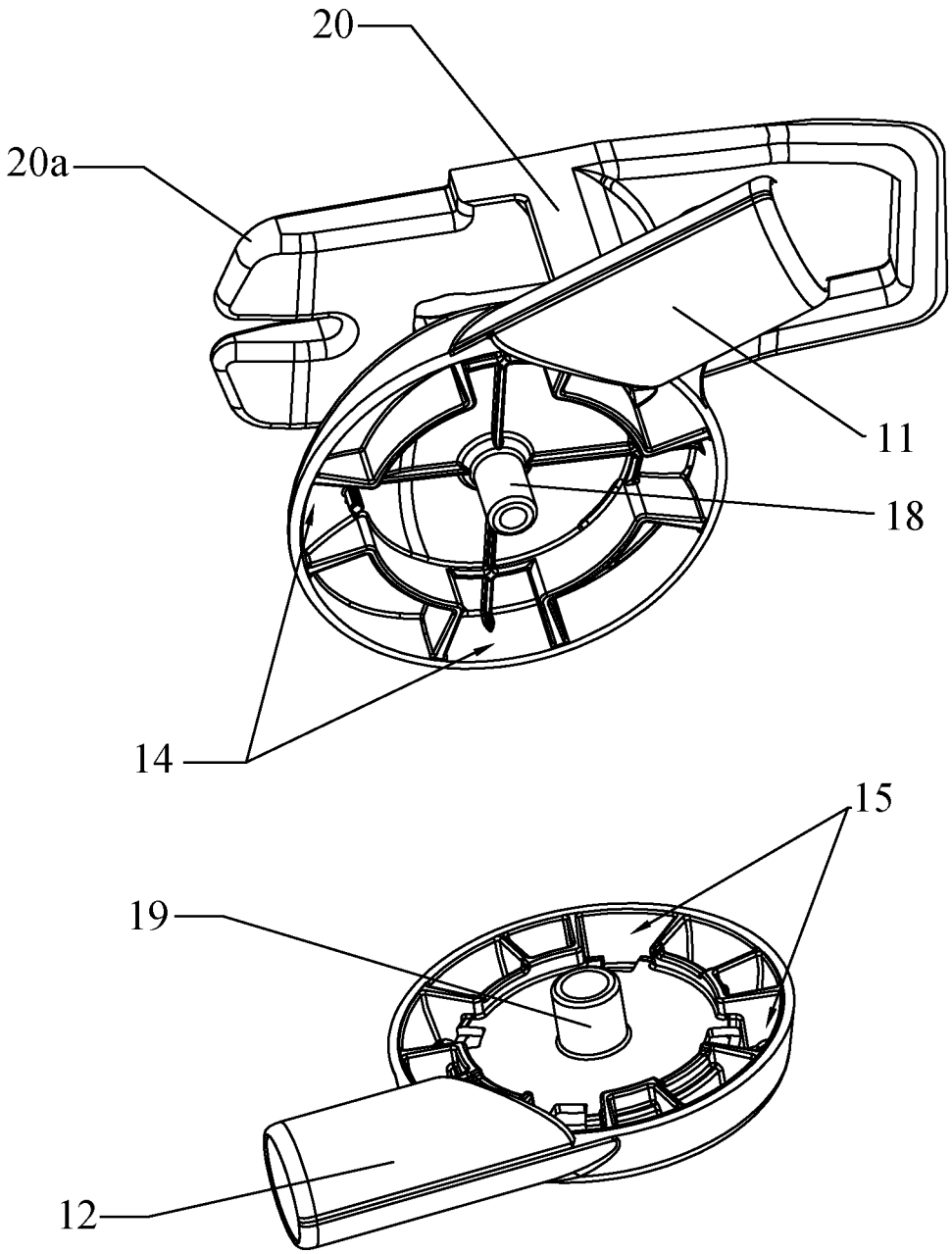
FIG. 4 is a schematic elevation of the structure of the second pivotal base of the unfolding and folding joint separated from the first pivotal base and the bearing base located on the first pivotal base shown in FIG. 3.
Figure 5:
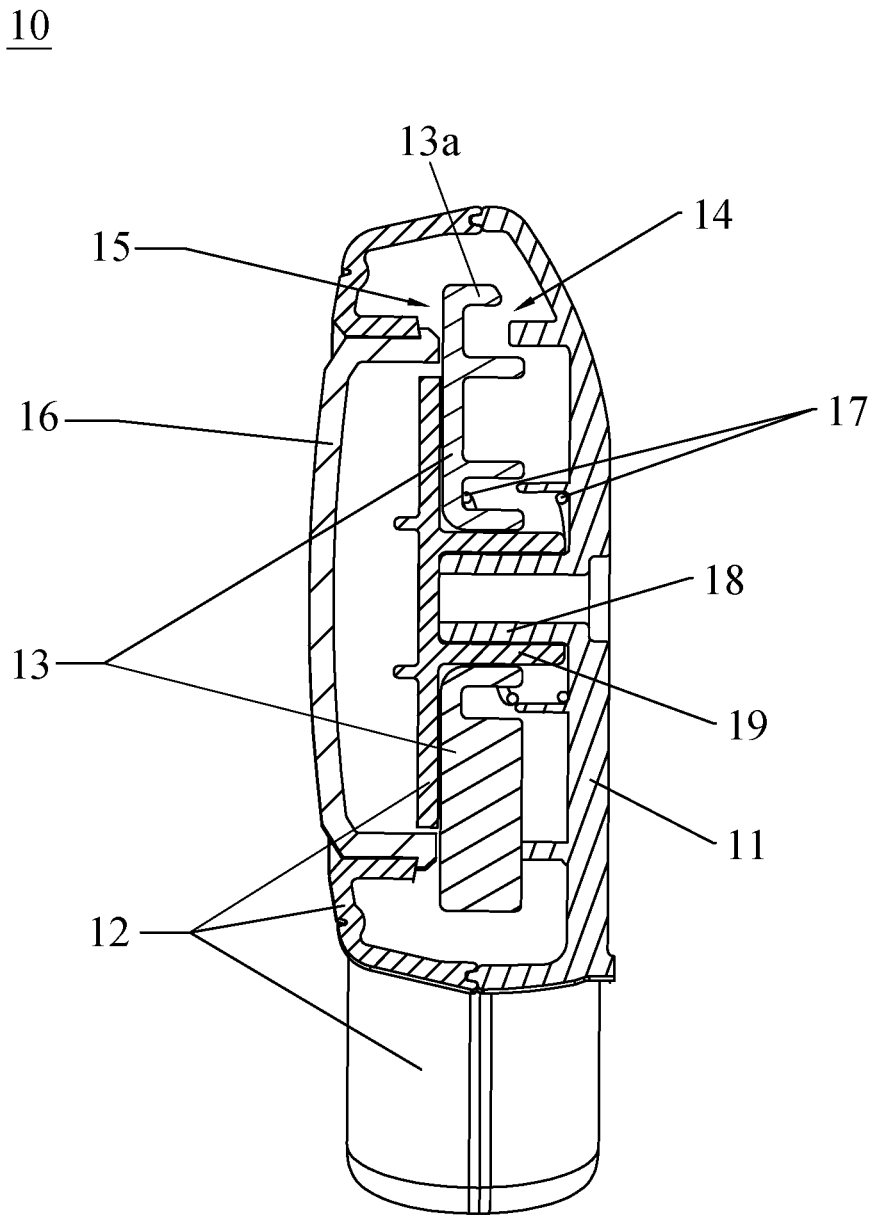
FIG. 5 is a schematic internal view of the unfolding and folding joint shown in FIG. 1 when the joint engaging piece is in a locking position.
Figure 6:
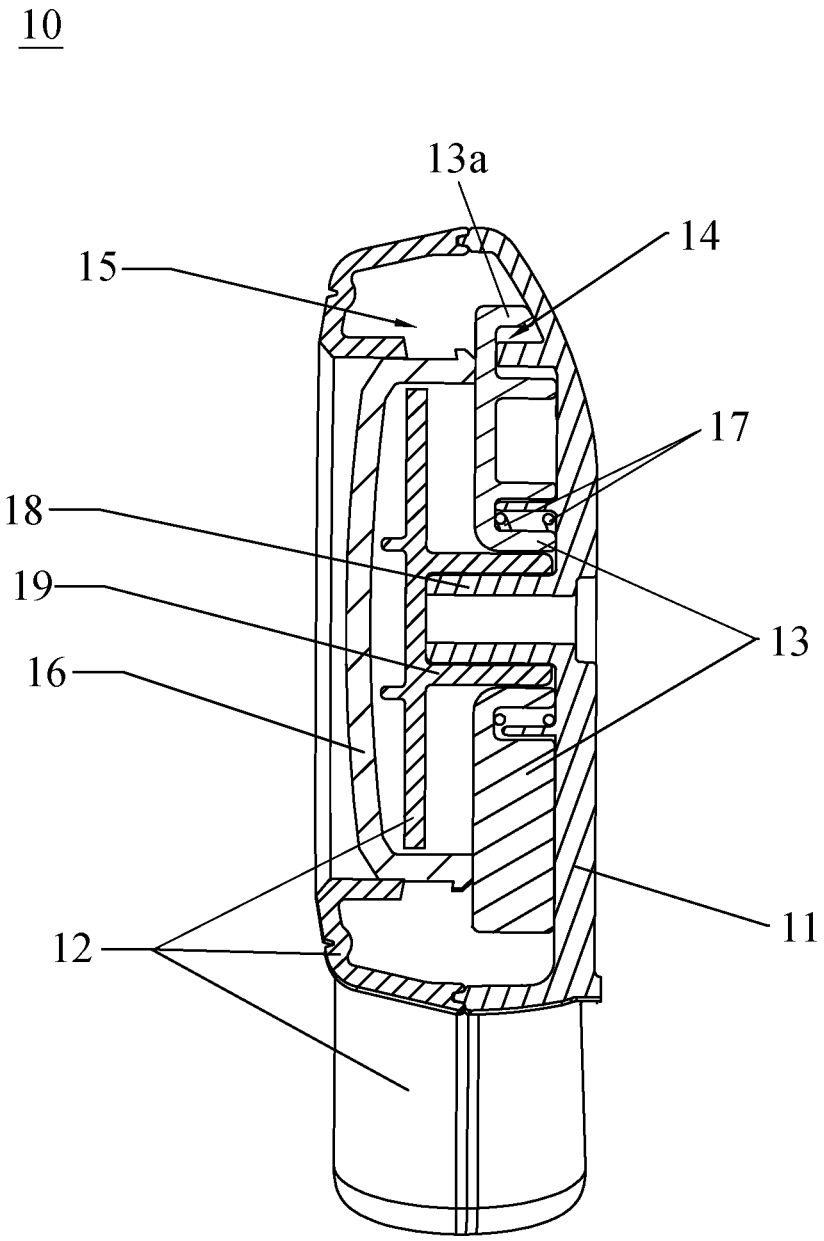
FIG. 6 is a schematic internal view of the unfolding and folding joint shown in FIG. 1 when the joint engaging piece is in a releasing position.

As shown in FIGS. 2, 3, 5 and 6, the joint engaging piece 13 can be movably set at a pivotal position of the first pivotal base 11 and the second pivotal base 12, the joint engaging piece 13 is used for engaging the first pivotal base 11 and the second pivotal base 12, in order to lock a pivotal rotation between the first pivotal base 11 and the second pivotal base 12. Specifically, the joint engaging piece 13 is axially sliding to assemble on the outer bushing 19. Certainly, the joint engaging piece 13 can also be assembled by other installation methods, so it is not limited to herein; in addition, the joint engaging piece 13 has a locking part 13*a*, and the first pivotal base 11 has a first positioning groove 14 formed thereon, the second pivotal base 12 has a second positioning groove 15 formed thereon; when the joint engaging piece 13 moves to a locking position as shown in FIG. 5, the locking part 13*a* is simultaneously engaged with the first positioning groove 14 and the second positioning groove 15, in order to lock the pivotal rotation between the first pivotal base 11 and the second pivotal base 12; when the joint engaging piece 13 moves to a releasing position as shown in FIG. 6, the locking part 13*a* is separated from the second positioning groove 15. Certainly, according to the actual needs, the locking part 13*a* can also be separated from the first positioning groove 14 in the releasing position, the same situation can make the first pivotal base 11 pivoted relative to the second pivotal base 12. In order to enable the joint engaging piece 13 to lock the first pivotal base 11 and the second pivotal base 12 when the first stand 30 and the second stand 40 are unfolded to each other or when they are folded to each other, in FIG. 4, the number of the second positioning groove 15 is four and they are separated from each other along a pivotal direction of the first pivotal base 11. Certainly, the number of the second positioning groove 15 can also be two or three, it is determined by the angle range of the first stand 30 and the second stand 40 pivoting to each other, after the first stand 30 and the second stand 40 are folded to each other, one of the four second positioning grooves 15 is aligned axially with the locking part 13*a*, and after the first stand 30 and the second stand 40 are unfold to each other, another of the four second positioning grooves 15 is aligned axially with the locking part 13*a*. Understandably, when the locking part 13*a* is separated from the first positioning groove 14 in the releasing position, at this time, the number of the first positioning groove 14 is four and they are separated from each other along a pivotal direction of the first pivotal base 11. Certainly, the number of the first positioning groove 14 can also be two or three, it is determined by the angle range of the first stand 30 and the second stand 40 pivoting to each other. It should be stated that the number of the locking part 13*a* may be one or more, and the first positioning groove 14 and the second positioning groove 15 are set the corresponding amount, for example, but not limited to the number of the locking part 13*a*, the first positioning groove 14 and the second positioning groove 15 are four each as shown in FIG. 3 and FIG. 4, as long as it can be ensured that the locking part 13*a* can be smoothly switched between the locking position and the releasing position after the first stand 30 and the second stand 40 are folded or unfolded to each other.

As shown in FIGS. 2, 3, 5 and 6, the operating piece 16 can be movably set on the second pivotal base 12, used to drive the joint engaging piece 13 to move to the releasing position as shown in FIG. 6, so that the locking part 13*a* is separated from the second positioning groove 15 and closer to the first positioning groove 14; since the operating piece 16 is set on the second pivotal base 12 and located on the outside of the unfolding and folding joint 10, it is more convenient for an operator to operate. For example, the operating piece 16 is a button that moves axially so that a user can release the locking by pressing. Understandably, when the bearing base 20 is formed on the second pivotal base 12, correspondingly, the operating piece 16 can be movably set on the first pivotal base 11, the same purpose can be achieved by the operating piece 16 driving the joint engaging piece 13 to move to the releasing position.

As shown in FIGS. 2, 3, 5 and 6, the elastic element 17 is used to drive the joint engaging piece 13, so that the joint engaging piece 13 moves to the locking position as shown in FIG. 5, and thus the joint engaging piece 13 can automatically slide to the locking position of the first pivotal base 11 and the second pivotal base 12. Specifically, the elastic element 17 is a spring, which is set between the joint engaging piece 13 and the first pivotal base 11, so that the axial space occupied by the joint engaging piece 13, the elastic element 17 and the first pivotal base 11 is smaller, and thus making their assembly more compact, but not limited to herein.

Referring to FIGS. 1-6, the working principle of the support frame of the disclosure is explained: when the user wants to fold the unfolded support frame 100 shown in FIG. 1, the user carries out the pressing operation of the operating piece 16 and the pressed operating piece 16 drives the joint engaging piece 13 to move to the releasing position as shown in FIG. 6 from the locking position as shown in FIG. 5, and the joint engaging piece 13 compresses the elastic element 17 during the movement until the locking part 13*a* is completely disengaged from the second positioning groove 15. At this time, since the second positioning groove 15 is no longer stuck by the locking part 13*a*, the user can push the second stand 40 to pivot downward relative to the first stand 30 to make the second stand 40 and the first stand 30 complete the folding, at this time, one of the four second positioning groove 15 is exactly aligned with the locking part 13*a* axially. Next, the user releases the press on the operating piece 16, and the joint engaging piece 13 is driven by the compressed elastic element 17 to automatically return to the locking position shown in FIG. 5 from the releasing position shown in FIG. 6. At the same time, the locking part 13*a* is also engaged with the first positioning groove 14 and the second positioning groove 15 in the process of following the movement of the joint engaging piece 13, so that the second stand 40 cannot be pivoted relative to the first stand 30, and thus the support frame 100 can be firmly in the folding state, so that the user carries out the subsequent storage.

When the user wants to unfold the folded support frame 100, the user carries out the pressing operation of the operating piece 16 and the pressed operating piece 16 drives the joint engaging piece 13 to move to the releasing position as shown in FIG. 6 from the locking position as shown in FIG. 5, so that the locking part 13*a* of the joint engaging piece 13 is disengaged from the fitting connection with the second positioning groove 15, and allows the second stand 40 can be pivoted relative to the first stand 30, and the elastic element 17 is compressed during the movement of the joint engaging piece 13; next, after the user pulls the second stand 40 to pivot upward relative to the first stand 30 to complete the unfolding, another of the four second positioning grooves 15 is exactly aligned with the locking part 13*a* axially. Then, the user releases the press on the operating piece 16, and the joint engaging piece 13 is driven by the compressed elastic element 17 to return to the locking position as shown in FIG. 5 from the releasing position as shown in FIG. 6 that results in the locking part 13*a* is also engaged with the first positioning groove 14 and the second positioning groove 15, so that the second stand 40 is blocked from pivoting relative to the first stand 30, and thus the support frame 100 can be firmly in the unfolding state as shown in FIG. 1 for the user to connect fittingly with a child carrier.

Understandably, the structure used to lock the pivotal rotation between the second stand 40 and the first stand 30 is not limited to the use of the locking part 13*a* of the joint engaging piece 13 engaging the positioning groove, other structures can also be used to achieve the same locking effect; for example, the joint engaging piece 13 is selected as a gear piece or a pin; when the joint engaging piece 13 is selected as a pin, the support frame 100 in the unfolding or folding state can use the locking part of the pin to insert into the positioning groove that is formed correspondingly on the first pivotal base 11 and the second pivotal base 12.

Referring to FIG. 7, the child seating device 1000*a* of the disclosure includes the support frame 100, a crib 300, and an assembling base 200*a*. The crib 300 is used to carry children; the assembling base 200*a* is set on the crib 300, so that the assembling base 200*a* and the crib 300 are assembled together; and the assembling base 200*a* and the bearing base 20 of the support frame 100 are engaged with each other, in order to assemble and detach to each other.

Referring to FIG. 8, the child seating device 1000*b* of the disclosure includes the support frame 100, a carry cot 400, and an assembling base 200*b*. The carry cot 400 is used to carry children; the assembling base 200*b* is set on the carry cot 400, so that the assembling base 200*b* and the carry cot 400 are assembled together; and the assembling base 200*b* and the bearing base 20 of the support frame 100 are engaged with each other, in order to assemble and detach to each other.

Referring to FIG. 9, the child seating device 1000*c* of the disclosure includes the support frame 100, a seat 500, and an assembling base 200*c*. The seat 500 is used to carry children; the assembling base 200*c* is set on the seat 500, so that the assembling base 200*c* and the seat 500 are assembled together; and the assembling base 200*c* and the bearing base 20 of the support frame 100 are engaged with each other, in order to assemble and detach to each other.

Understandably, the crib 300, the carry cot 400 and the seat 500 can be collectively referred to as child carriers; in addition, in other embodiments, according to the actual needs, one or more of the elastic elements 17, the joint engaging piece 13 and the operating piece 16 can be omitted.

Compared with the art of the state, with the aid of the bearing bases 20 formed on the unfolding and folding joint 10, the support frame 100 of the disclosure has multiple modes of use when the bearing bases 20 are connected fittingly with different child carriers such as the crib 300, carry cot 400 or seat 500; in addition, with the aid of the unfolding and folding joint 10, the first stand 30 and the second stand 40 can be folded or unfolded to each other according to demand, thus facilitating storage. In addition, for the child seating device 1000*a* (1000*b*, 1000*c*) of the disclosure, with the aid of the assembling base 200*a* (200*b*, 200*c*) engaging the bearing base 20, it makes the child seating device 1000*a* (1000*b*, 1000*c*) of the disclosure has multiple modes of use when the support frame 100 is connected fittingly with different child carriers.

The above only discloses preferred embodiments of the disclosure, the scope of the disclosure cannot be limited by the foregoing description, so all changes which come within the meaning and range of the equivalency according to the claims of the disclosure are therefore intended to be embraced therein.

What is claimed is:

1. A support frame of a child seating device, comprising:

unfolding and folding joints, wherein each unfolding and folding joint comprises:

a first pivotal base having first positioning grooves formed thereon, wherein the first positioning grooves are separated from each other along a pivotal direction of the first pivotal base;

a second pivotal base pivotally connected to the first pivotal base and having second positioning grooves formed thereon, wherein the second positioning grooves are separated from each other along the pivotal direction; and a joint engaging piece movably set at a pivotal position of the first pivotal base and the second pivotal base and having locking parts;

bearing bases, formed on the unfolding and folding joints;

a first stand, assembled with the first pivotal bases; and a second stand, assembled with the second pivotal bases, the second stand is connected pivotally to the first stand via the unfolding and folding joints;

wherein each of the unfolding and folding joints further comprises:

an operating piece, movably set on one of the first pivotal base and the second pivotal base, wherein the operating piece is used to drive the joint engaging piece to move to the releasing position by abutting and pushing against the locking parts of the joint engaging piece.

2. The support frame according to claim 1, wherein the bearing bases are formed on the first pivotal bases or the second pivotal bases.

3. The support frame according to claim 1, wherein the joint engaging pieces are used for engaging the first pivotal bases and the second pivotal bases, in order to lock a pivotal rotation between the first pivotal bases and the second pivotal bases.

4. The support frame according to claim 1, wherein the joint engaging pieces are axially and movably set between the first pivotal bases and the second pivotal bases; when the joint engaging pieces moves to a locking position, the locking parts are simultaneously engaged with the first positioning grooves and the second positioning grooves, in order to lock the pivotal rotation between the first pivotal bases and the second pivotal bases; when the joint engaging pieces moves to a releasing position, the locking parts are separated from the first positioning grooves or the second positioning grooves, so that the first pivotal bases are pivoted relative to the second pivotal bases.

5. The support frame according to claim 4, wherein each of the unfolding and folding joints further comprises:

an elastic element, configured to drive the joint engaging piece, so that the joint engaging piece moves to the locking position.

6. The support frame according to claim 5, wherein the elastic element is a spring, and the spring is set between the joint engaging piece and the first pivotal base or the second pivotal base on which the bearing base is located.

7. The support frame according to claim 1, wherein the bearing base is located on another of the first pivotal base and the second pivotal base.

8. The support frame according to claim 7, wherein the operating piece is a button, and the button moves axially.

9. The support frame according to claim 1, wherein the joint engaging pieces are gear pieces or pins.

10. The support frame according to claim 1, wherein after the first stand and the second stand are folded to each other, ones of the first positioning grooves and the second positioning grooves are aligned axially with the locking parts; after the first stand and the second stand are unfold to each other, another ones of the first positioning grooves and the second positioning grooves are aligned axially with the locking parts.

11. The support frame according to claim 1, wherein each of the bearing bases has a face-up connector.

12. A child seating device, comprising a child carrier, wherein the child seating device further comprises:

an assembling base, set on the child carrier; and the support frame of claim 1, the assembling base and the bearing bases are engaged with each other.

13. The child seating device according to claim 12, wherein the child carrier is a crib, a carry cot or a seat.

14. The child seating device according to claim 1, wherein when the joint engaging pieces moves to a locking position, the first positioning grooves and the second positioning grooves are axially aligned with each other to form a receiving space and each of the locking parts is engaged into the receiving space to be simultaneously engaged with one of the first positioning grooves and a corresponding second positioning groove.

* * * * *